United States Patent [19]

Price

[11] 4,285,737

[45] Aug. 25, 1981

[54] METHOD OF CLEANING RAILROAD TRACK

[76] Inventor: John G. Price, Box 3197, Montgomery, Ala. 36109

[21] Appl. No.: 57,088

[22] Filed: Jul. 12, 1979

Related U.S. Application Data

[62] Division of Ser. No. 909,476, May 25, 1978, Pat. No. 4,184,223.

[51] Int. Cl.[3] ..... B08B 1/04

[52] U.S. Cl. ..... 134/6; 15/55

[58] Field of Search ..... 15/159 R, 159 A, 179–183, 15/186–188, 21 E, 54, 55; 51/332, 334–336; 300/21; 134/6

[56] References Cited

U.S. PATENT DOCUMENTS

| | | | |
|---|---|---|---|
| 3,087,179 | 4/1963 | Talboys | 15/55 |
| 3,137,018 | 6/1964 | Seffker | 15/55 |
| 3,256,545 | 6/1966 | Lewis et al. | 15/159 A |
| 3,353,200 | 11/1967 | Charvat | 15/159 A |
| 3,391,025 | 7/1968 | Foxx et al. | 15/55 X |
| 3,402,416 | 9/1968 | Shaw et al. | 15/187 X |
| 4,144,610 | 3/1979 | Moore et al. | 15/55 X |

*Primary Examiner*—Marc L. Caroff

*Attorney, Agent, or Firm*—Sherman & Shalloway

[57] ABSTRACT

A method for clearing a railway roadbed of loose material employs elongate sweeper bristle elements, each element comprising a stem terminating in a knob portion which functions as a solid weighting mass and which forms a forward wearing surface. The method includes the steps of rotating a plurality of the sweeper bristle elements over the railway roadbed to be cleared so that the ends of the elements contact the loose material; imparting a centrifugal force on the stem and knob; and striking the loose material with the knob, thereby causing the loose material which contacts the knob to be driven away from the element.

The preferred sweeper bristle elements are each comprised of a solid elastomeric stem preferably made of 80 durometer rubber. The stem extends substantially the length of the element and has upper and lower portions. A solid weighting mass forming a forward wearing surface and preferably made from 60 durometer rubber is attached to the lower portion of the stem. The upper portion of the stem engages a rotating drum.

The rotation of the drum imparts a centrifugal force on the stem and the knob causing loose material which contacts the element to be driven away from the element.

2 Claims, 3 Drawing Figures

METHOD OF CLEANING RAILROAD TRACK

This is a division, of application Ser. No. 909,476, filed May 25, 1978, now U.S. Pat. No. 4,184,223.

BACKGROUND OF THE INVENTION

1. Field of the Invention

The invention generally relates to a broom machine especially adapted for construction and maintenance work on a railway roadbed or track, as for dressing the surface of the ballast bed between and along the sides of the rails, and for leveling and distributing ballast over the bed.

In particular, the invention is concerned with a sweeper bristle element employed in combination with a rotating drum and element support means for use on a railway roadbed or track cleaner.

2. Description of the Prior Art

Railway ballast comprises a thick layer of crushed limestone or similar material resting on a prepared base and in which the track cross ties are embedded and supported. The ballast bed is shaped to have a generally horizontal top face over the lengths of the ties, that is, between the rails and alongside the rails and to have sloped banks at and beyond the ends of the ties. Desirably, the top surface of the ballast is level with or slightly below the top faces of the ties, and the ties and rails should be free of loose ballast and debris.

Both in maintenance and in original construction of the roadbed, new ballast is dumped onto the roadbed from cars and is roughly distributed by a blade device, such as a plow or moldboard. It is not possible, however, for such a blade device to produce the desired finish condition in which the ballast is level with or slightly below the tops of the ties. A brush or broom implement can produce the desired distribution and surface condition. The sweeping of ballast, however, imposes a severe load on the broom so that brooms are subject to heavy wear and short life.

The prior art discloses brooms which are constructed with bristles comprised of lengths of steel cable removably fastened to the mandrel or drum of the broom and encased in sections of heavy-duty hose to control fraying of the cable. With such a broom, it was found that in ballast dressing operations, such steel cable bristles would last only about two hours and would sweep less than five miles of track before requiring replacement. Further, such bristles require significant replacement time and, generally, it took two men two full days to replace the bristles. With such steel-cable bristles, the broom gave less than one man-day of service for each four man-days of repair, and this was economically impractical.

To overcome this problem, bristle elements, as disclosed in U.S. Pat. No. 3,649,984 invented by Kershaw, et al., have been suggested. Therein is disclosed a bristle element which is replaceably mounted on a mandrel rotatable on a horizontal axis. The bristle elements have a core made of a bundle of parallel straight spring-steel splines or wires fixed together at one end in a detachable coupling and encased in a resilient sheath which binds the splines into mutually supporting relation and distributes flexing stress in them away from their fixed end. In effect, the bristles suggested by Kershaw, et al., are primarily steel bristles, attempting to use wire as the main item in the construction. It is very complex to manufacture and quite expensive to assemble because of the many and various components and the machining necessary to create the structure. Fundamentally, it provides the same function as a cable and differs only in that it includes straight instead of twisted wires. The straight wires still suffer from the eventual frazzle which occurs in a cable and the rubber casing only functions to hold the frazzled wires together for a slightly longer period of time before breakdown.

SUMMARY OF THE INVENTION

Applicant has found that a solid bristle of elastomeric material overcomes many of the disadvantages found in the prior art. Such a sweeper bristle element may be employed for use on a railway roadbed or track cleaner wherein a horizontally rotating drum has element support means located thereon. Specifically, the element is comprised of a solid rubber stem of hard rubber (80 durometer as measured on a Shore, type-A, durometer gauge) extending substantially the entire length of the element, the stem having upper and lower portions. A solid soft rubber knob (60 durometer as measured on a Shore, type-A, durometer gauge) is integrally laminated to the lower portion of the stem. The upper portion of the stem engages the element support means and rotation of the drum imparts a centrifugal force on the stem and knob, causing loose material which contacts the knob to be driven away from the element.

By employing the above-described bristle, a method of clearing a railway roadbed is disclosed comprising the steps of rotating a plurality of the sweeper bristle elements over the railway roadbed to be cleared so that the ends of the elements contact the loose material; imparting a centrifugal force on the stem and knob; and striking the loose material with the knob, thereby causing the loose material which contacts the knob to be driven away from the element.

It is an object of this invention to disclose a sweeper bristle element which makes use of the inherent ability of elastomeric materials to function more efficiently and last longer in abrasive applications than metallic materials.

It is a further object of this invention to disclose a sweeper bristle element which is comprised of integrally laminated layers of 60 durometer rubber and 80 durometer rubber.

It is a further object to disclose a sweeper bristle element which merely moves aside when striding or brushing a fixed object.

Another object of this invention is to describe a sweeper bristle element which will not scrape or dig into the railway roadbed or track on which it is employed.

It is a further object of this invention to describe a method of clearing a railway roadbed which makes use of the centrifugal force imparted on the bristles of a rotary broom and the brushing action of the rotary broom bristles as opposed to the scraping or raking action of the bristles employed in the prior art.

It is a further object of this invention to describe a sweeper bristle element which drives loose material contacting the end of the element away from the element, much like a golf club striking a golf ball.

It is still another object of this invention to describe a sweeper bristle element having a solid construction which may be formed from elastomeric or other plastic and resilient type materials.

BRIEF DESCRIPTION OF THE DRAWINGS

These objects and features of the invention, as well as others, will become apparent to those skilled in the art by referring to the accompanying drawings in which.

DETAILED DESCRIPTION OF THE INVENTION

Figure 1:
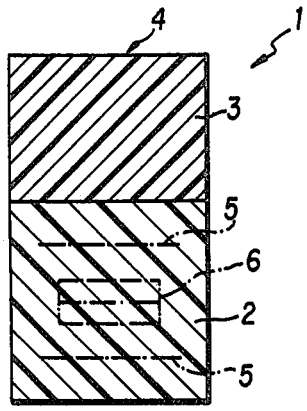
FIG. 1 is a sectional view of the lower portion of the sweeper bristle element according to the invention.
Figure 2:
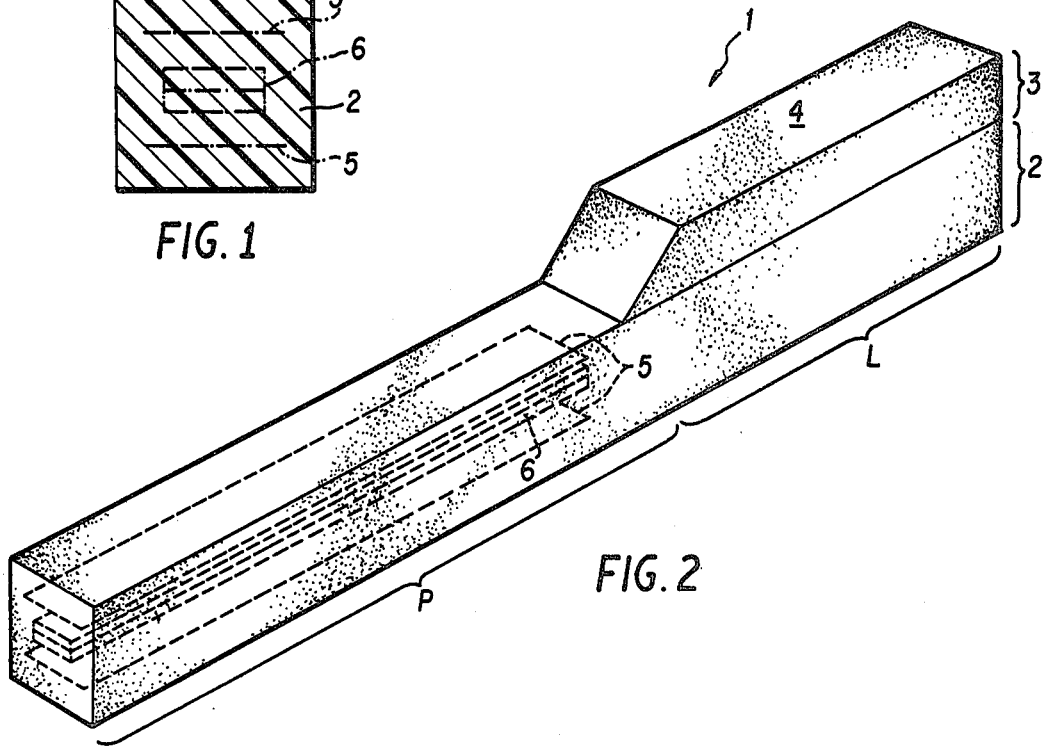
FIG. 2 is a perspective view of the sweeper bristle element of the invention.
Figure 3:
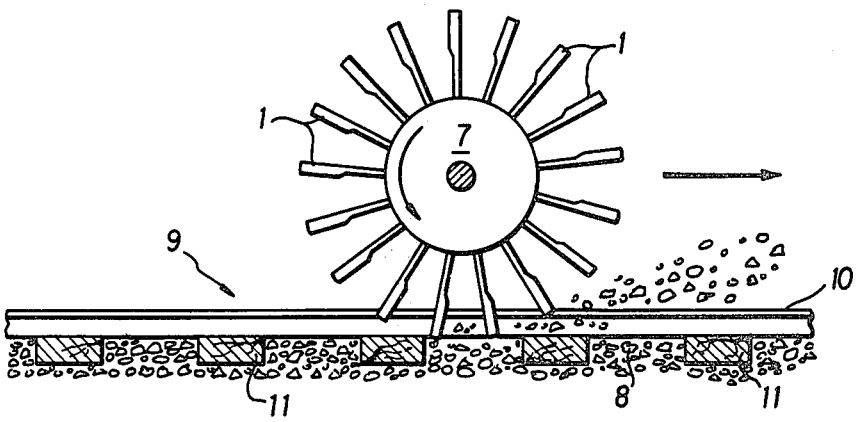
FIG. 3 is a side view showing the sweeper bristle element mounted in a horizontally rotating drum located over a railway roadbed.

The sweeper bristle element 1, as illustrated in perspective in FIG. 2, is comprised of a solid elastomeric stem 2 which is integrally laminated with a solid weighting mass 3. Preferably, the weighting mass 3 is a solid elastomeric knob forming a forward wearing surface 4. The solid elastomeric stem may optionally be reinforced by a fabric 5, such as nylon, which extends the entire length of the stem 2 parallel to its sides. Alternatively, spring steel 6 in the shape of an "I" beam or other reinforceable shape may be employed as the reinforcing material embedded within the stem 2.

The stem has a lower portion L and an upper portion P. The solid elastomeric knob, which is the weighting mass 3, is integrally laminated to the lower portion L of the solid elastomeric stem 2. Preferably, the length of the stem 2 is approximately eighteen (18) inches and the lower portion L comprises one-third or six (6) inches of the entire length of the stem 2. The cross section of the stem 2 is preferably square and having a one and three eighths inch dimension. The weighting mass 3 is preferably one inch in depth and one and three-eighths inch in width corresponding to the width of the stem 2. It has been found that such dimensions are of a critical nature. For example, substantial extension of the sweeper bristle element 1 beyond eighteen (18) inches results in a structure which is overly flexible. Similarly, substantial decreases in the depth or width of the solid elastomeric stem 2 significantly affects the ability of the stem 2 to properly support the bristle 1 while in use.

In a preferred embodiment, the solid elastomeric stem 2 is comprised of an elastomeric material, such as rubber, or a composition blend of rubber and plastic, which has an 80 durometer on a Shore, type-A, durometer gauge. This is considered to be a "hard" type of rubber, thereby allowing the stem 2 to support the bristle 1 straight at all times. The solid weighting mass 3 is preferably comprised of a rubber or composition blend of rubber and plastic which has a 60 durometer on a Shore, type-A, durometer gauge. This is considered a "soft" type rubber and is similar to a high-grade tire tread stock. The forward wearing surface 4, which is preferably planar, is formed by such soft rubber so that maximum resistance to abrasion may be obtained. The knob formed by the soft rubber pad gives the bristle a centrifugal force designed to drive loose material before it, very much like a golf club driving and striking a ball, when the drum is turned at a reasonable speed.

The sweeper bristle element is structured to take advantage of the natural ability of elastomeric materials to out-wear metallic materials, such as steel, many times over in abrasive applications. The sweeper bristle element overcomes the disadvantages of the prior art bristles for rotary brooms which were either comprised of materials such as cables or wires, or used very limited amounts of rubber as a covering, retaining, or stiffening material. The employment of an elastomeric solid material as a bristle and a wear surface forms the basis of the disclosed invention.

MODE OF OPERATION OF THE INVENTION

In use, the sweeper bristle is mounted to radially project from a horizontal drum 7 by any convenient element support means, such as a clamp, vise, threaded closure, or other similar means well known and employed in the prior art. The drum 7 is located over a railway roadbed 9 which includes track 10 and ties 11. Ballast 8, in the form of crushed limestone or other loose material, is located between the ties 11 and around the entire roadbed 9.

The sweeper bristle element 1 functions and depends upon the centrifugal force created by rotating the drum 7 at approximately 250 rpm. This fast turning of the drum causes the forward wearing surface 4 of the knob of the sweeper bristle element 1 to strike the ballast 8 and drive it away from the element. The result is the flat, even distribution of the ballast along a roadbed which has been cleaned or cleared by a broom machine employing a drum 7 with sweeper bristle elements 1 according to the invention. Alternatively the drum 7 may employ slow turning, thereby creating a brushing action of the sweeper bristle element 1. This is in contrast with the steel bristles of the prior art which are strictly limited in their function to scraping or raking action of the ballast.

A unique and desirable feature of the sweeper bristle element 1 is its ability to flex in any direction. The solid element 1 generally has been found to move aside when striding or brushing a fixed object. This prevents the element 1 from scraping or digging into the object, such as track 10 or ties 11.

The reinforced fabric layers 5 generally serve to prevent the elastomeric material from which the bristle is constructed from tearing if cut by a sharp or knife-like object. The spring steel inserts 6, which may be used in addition to the fabric, add stiffness to the upper portion P of the bristle. However, in certain applications the steel spring inserts are undesirable because of the risk of fatigue and failure due to crystallization.

The use of the above sweeper bristle element 1 provides a method of clearing a railway roadbed of loose material, such as ballast 8. The process particularly includes the steps of rotating a plurality of the sweeper bristle element 1 having a stem 2 with a knob 4 thereon over the railway roadbed 9 to be cleared. The rotation is performed such that the ends of the element 1 and, in particular, the knob and forward wearing surface 4, contact the ballast 8. Such rotation imparts a centrifugal force on the stem 2 and especially the knob 4 so that the striking of the loose material by the knob 4 causes the loose material to be driven away from the element.

The sweeper bristle element 1 may be manufactured by any known technique employed by the prior art. For example, molding or extrusion techniques may be used. One manufacturing method which has an applicable technique for making the sweeper bristle element 1 is the use of an extrusion of rubber approximately one and three-eighths of an inch wide by seven-sixteenths of an inch thick, stacked into a mold with a ply of belt fabric, such as nylon between the layers. The 60 durometer knob 4 is added to the layers at one end and the entire structure is vulcanized in a flatbed press. This results in a rectangular cross-sectional shape for the lower portion L and a square cross-sectional shape for the upper portion P which is a convenience in manufacturing and a functional advancement over the prior art.

Various changes may be made in the details of the invention, as disclosed, without sacrificing the advantages thereof or departing from the scope of the appended claims. Furthermore, although the present invention has been disclosed and discussed with particular regard to its exceptional advantages in terms of sweeper bristle elements adapted for use on a railway roadbed or track cleaner employing a rotating drum with element support means, it may be understood that the invention may be employed in several industrial applications wherein loose material is moved or leveled. In addition, it is understood that the terms elastomer and elastomeric material, as used herein, refer generally to any resilient material, and it is contemplated that the sweeper bristle element may be fabricated with any materials which register the equivalent to 60 to 80 durometer on a Shore, type-A, durometer gauge or similar type gauge.

What is claimed is:

1. A method of clearing a railway roadbed of loose material comprising the steps of:

(a) providing a drum with a plurality of radially-projecting elastomeric sweeper elements, each element comprising a unitary stem portion terminating in a knob portion, the knob portion having a substantially larger cross-sectional area than the stem portion and formed as a weighting mass, the stem and knob portions being formed into a unitary structure with the knob portion having a substantially planar forward surface;

(b) rotating the drum with the radially projecting sweeper bristle elements over the railway roadbed to be cleared so that said forward surface contacts the loose material;

(c) imparting a centrifugal force on said stem and said knob, wherein the knob portion is imparted with a portion of said centrifugal force proportionally greater than its mass relative to the mass of the stem portion;

(d) striking the loose material with said knob with sufficient force to cause the loose material which contacts said knob to be driven away from said element, wherein said centrifugal force and a mass inertia imparted on the elements by said rotating drum enables the bristle elements to move ballast along a railway roadbed.

2. A method of clearing a railway roadbed of loose material comprising the steps of:

(a) providing a drum with sweeper bristle elements, each sweeper bristle element further comprising:

a solid one-piece elastomeric stem extending substantially the length of said element, said stem having an upper portion and a lower portion with a forward surface terminating with a flat end portion; and a solid one-piece elastomeric substantially planar knob with a lower flat end portion, said knob being integral with and laminated to said solid elastomeric stem, said knob attached to the forward surface of the lower portion of said stem, said flat end portion of the knob being aligned with said flat end portion of said stem, said knob forming a forward wearing and driving surface whereby said upper portion engages said element support means and rotation of said drum imparts a centrifugal force on said stem and especially said knob, causing loose material which contacts said knob to be driven away from said element;

(b) rotating the drum over the railway roadbed to be cleared so that said forward surface contacts the loose materials;

(c) imparting a centrifugal force on said stem and especially said knob; and (d) striking the loose material with said knob with sufficient force to cause the loose material which contacts said knob to be driven away from said element.

* * * * *